US007809303B2

(12) United States Patent
Igarashi

(10) Patent No.: US 7,809,303 B2
(45) Date of Patent: Oct. 5, 2010

(54) IMAGE FORMING APPARATUS HAVING AN AIR PASSAGE AND OUTLET

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 584 days.

(21) Appl. No.: 11/533,564

(22) Filed: Sep. 20, 2006

(65) Prior Publication Data

US 2007/0071484 A1 Mar. 29, 2007

(30) Foreign Application Priority Data

Sep. 26, 2005 (JP) ..... 2005-277900

(51) Int. Cl.
*G03G 21/20* (2006.01)

(52) U.S. Cl. ..... 399/92; 399/112

(58) Field of Classification Search ..... 399/92, 399/93, 179, 299, 303; 347/115, 117, 118, 347/232

See application file for complete search history.

(56) References Cited

U.S. PATENT DOCUMENTS

| | | | | |
|---|---|---|---|---|
| 5,325,158 | A * | 6/1994 | Guelfo et al. | 399/92 |
| 6,141,512 | A * | 10/2000 | Nagano et al. | 399/92 |
| 6,148,159 | A * | 11/2000 | Shiraishi | 399/44 |
| 6,266,498 | B1 * | 7/2001 | Oda et al. | 399/92 |
| 6,463,236 | B2 * | 10/2002 | Morikami et al. | 399/121 |
| 6,708,011 | B2 | 3/2004 | Nomura et al. | |
| 6,754,458 | B2 * | 6/2004 | Makihira | 399/92 |
| 6,799,010 | B2 * | 9/2004 | Namiki | 399/298 |
| 6,859,635 | B2 * | 2/2005 | Yabuki et al. | 399/299 |
| 6,882,809 | B2 | 4/2005 | Hirose et al. | |
| 6,985,677 | B2 * | 1/2006 | Yamagata et al. | 399/18 |
| 7,110,694 | B2 * | 9/2006 | Ito | 399/92 |
| 7,194,223 | B2 * | 3/2007 | Hachisuga | 399/92 |
| 7,400,842 | B2 * | 7/2008 | Takehara et al. | 399/92 |
| 7,469,112 | B2 * | 12/2008 | Yuasa | 399/92 |
| 2004/0096229 | A1 | 5/2004 | Yoshihara et al. | |
| 2004/0234301 | A1 | 11/2004 | Sato et al. | |

FOREIGN PATENT DOCUMENTS

| | | | |
|---|---|---|---|
| JP | 08171317 | A * | 7/1996 |
| JP | 8262959 | A | 10/1996 |
| JP | 9185312 | A | 7/1997 |
| JP | 10319666 | A * | 12/1998 |
| JP | 2000321840 | A * | 11/2000 |
| JP | 2002116670 | A | 4/2002 |

(Continued)

*Primary Examiner*—Robert Beatty
(74) *Attorney, Agent, or Firm*—Banner & Witcoff, Ltd.

(57) ABSTRACT

An image forming apparatus is provided which includes a process unit including image formation units, each of the image formation units having an image carrier, a charger, and a developing device, a scanner unit disposed facing the process unit and configured to expose the image carrier in each of the image formation units to light, and a fixing device disposed in the first direction with respect to the process unit. Also, the image forming device includes a first passage configured to channel air between the process unit and the scanner unit to an outlet in the first direction and a second passage configured to channel air in the vicinity of the fixing device to the outlet in a second direction that is substantially perpendicular to the first direction.

26 Claims, 3 Drawing Sheets

FOREIGN PATENT DOCUMENTS

| | | | | |
|---|---|---|---|---|
| JP | 2003107838 | A | | 4/2003 |
| JP | 2003287996 | A | | 10/2003 |
| JP | 2003295739 | A | * | 10/2003 |
| JP | 2004093708 | A | | 3/2004 |
| JP | 2004287216 | A | | 10/2004 |

* cited by examiner

IMAGE FORMING APPARATUS HAVING AN AIR PASSAGE AND OUTLET

CROSS REFERENCE TO RELATED APPLICATIONS

This application claims priority from Japanese Patent Application No. 2005-277900 filed on Sep. 26, 2005, the entire subject matter of which is incorporated herein by reference.

FIELD

Aspects of the invention relate to image forming apparatus, and, more particularly, to tandem-type image forming apparatuses.

BACKGROUND

As an electrophotographic image forming apparatus, tandem color laser printers are known. For example, an image forming apparatus includes, in a body casing, a process unit including image formation units provided for each color. Each of the image formation units includes a photosensitive drum, a developing device, and a charger. The process unit is removable from the body casing in a sideways direction so that the developing device can be replaced when the process unit is pulled out. The body casing includes a conveyor belt that is disposed below the process unit and conveys a sheet, a scanner unit that is disposed above the process unit to irradiate the photosensitive drum of each image formation unit with laser light, and a fixing device disposed at the rear of the process unit (on a downstream side with respect to a sheet feeding direction). Such an image forming apparatus generally includes an exhaust duct that communicates with an exhaust outlet and an exhaust fan disposed inside the exhaust duct to remove heat generated in the body casing. The exhaust duct intake opening is, for example, between the fixing device and the process unit so that air around the fixing device and air around the lower portion of the process unit can be routed outside through the exhaust duct.

However, as the above-described configuration does not include anything to cut off heat between the process unit and the scanner unit, heat built up around the process unit travels to the scanner unit, and the temperature in the scanner unit is increased. When the temperature in the scanner unit becomes high, the housing of the scanner unit expands, and laser light may be irradiated on the photosensitive drum out of position, which may produce an adverse effect such as misalignment of colors in images.

SUMMARY

Aspects of the invention provide an image forming apparatus configured to prevent heat from building up between a process unit and a scanner unit.

BRIEF DESCRIPTION OF THE DRAWINGS

Aspects of the invention will be described in detail with reference to various example structures and the following figures, wherein.

DETAILED DESCRIPTION

Illustrative aspects of the invention will be described with reference to FIGS. 1 to 3.

Entire Structure of Laser Printer

Figure 1:
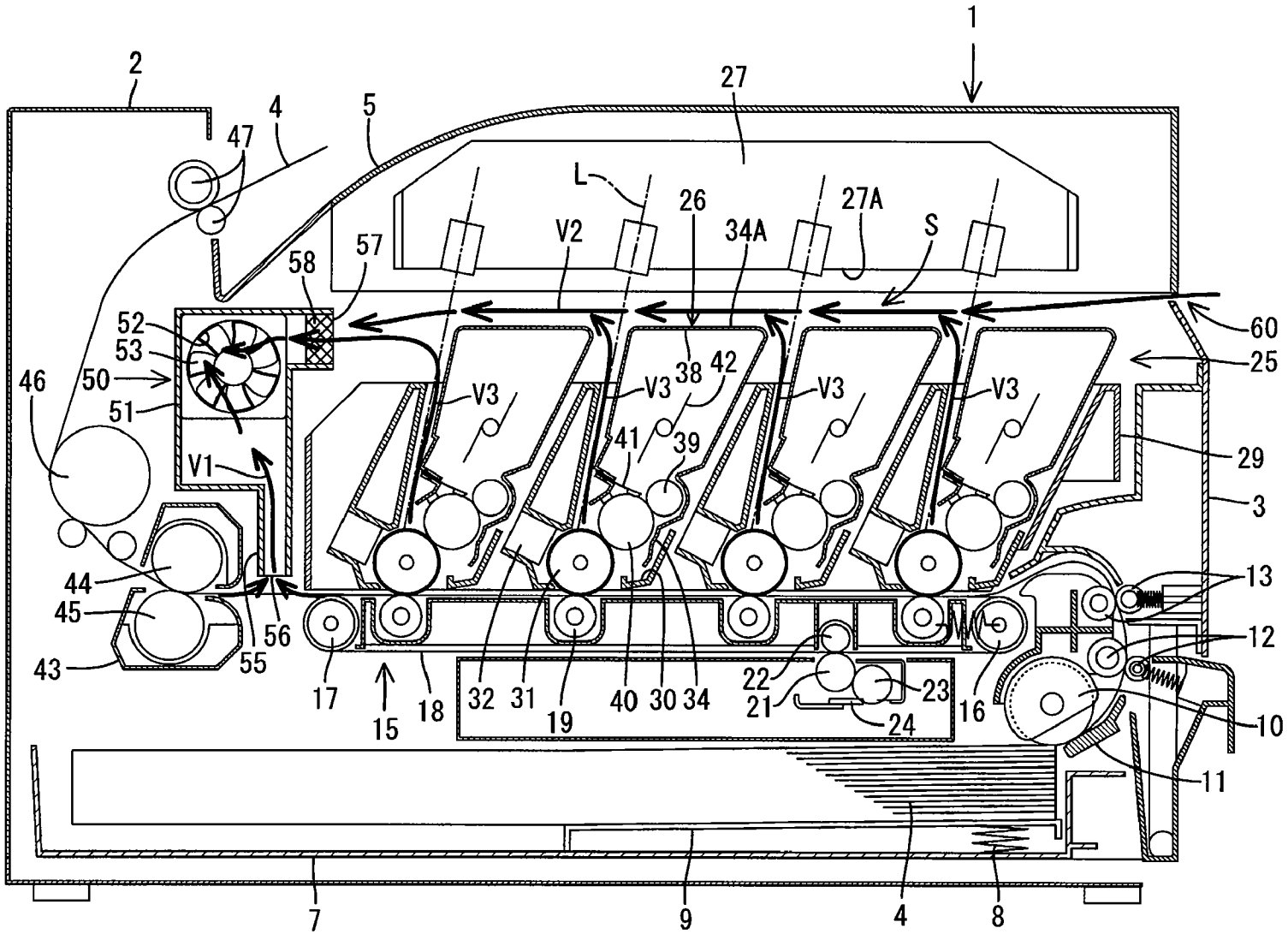
FIG. 1 is a side sectional view showing a general structure of a laser printer as an image forming apparatus according to an illustrative aspect of the invention.

In the following description, a right side in FIG. 1 is referred to as a front side of a laser printer 1.

The laser printer 1 is a direct transfer tandem type color laser printer. While aspects of the invention are described with respect to a laser printer, it will be appreciated that these aspects may be applied to other image forming devices including, but not limited to, multi-function devices, scanners, facsimiles, copiers and the like. As shown in FIG. 1, the laser printer 1 includes a body casing 2 having a substantially box shape. An openable front cover 3 is provided on the front of the body casing 2. When the front cover 3 is open, a process unit 25 may be removed from the body casing 2 toward the front direction. An output tray 5 is formed on the top of the body casing 2. An image is formed on a sheet 4 serving as a recording medium and the sheet 4 is ejected and placed in the output tray 5. An input tray 7 for holding a stack of sheets 4 is mounted in a bottom portion of the body casing 2. The input tray 7 can be inserted into and removed from the front of the body casing 2. The input tray 7 includes a plate 9 that is urged upwardly by a spring 8 to raise the front end side of the sheets 4. A pickup roller 10 and a separation pad 11 are provided above the front end of the input tray 7. The separation pad 11 is pressed into contact with the pickup roller 10 against the urging force of a spring (not shown). A pair of sheet supply rollers 12 is provided diagonally to the front above the pickup roller 10, and a pair of register rollers 13 is provided above the sheet supply rollers 12.

An uppermost sheet 4 in the stack of sheets in the input tray 7 is pressed against the pickup roller 10 by the plate 9, and is separated from the stack when it is pinched between the pickup roller 10 and the separation pad 11 by rotation of the pickup roller 10. The sheet, which is fed out from between the pickup roller 10 and the separation pad 11, is fed to the register rollers 13 by the sheet supply rollers 12. The sheet 4 is fed to a belt unit 15, which is disposed behind the register rollers 13, with a specified timing.

The belt unit 15 is detachable from the body casing 2. The belt unit 15 includes a pair of belt support rollers 16, 17 and a conveyor belt 18. The conveyor belt 18 is horizontally stretched between the belt support rollers 16, 17, which are disposed at front and rear of the belt 18 and spaced apart from each other. The conveyor belt 18 is a circular belt and is formed of a resin such as polycarbonate. When the rear belt support roller 17 is rotated, the conveyor belt 18 is moved in a counterclockwise direction in FIG. 1 to feed the sheet 4 placed on the conveyor belt 18 to the rear. Inside the conveyor belt 18, four transfer rollers 19 are aligned side by side at established intervals in the front-rear direction. The four transfer rollers 19 are disposed to face corresponding photosensitive drums 31 included in image formation units 26. The conveyor belt 18 is pinched between the transfer rollers 19 and the corresponding photosensitive drums 31. During image transfer, a transfer bias is applied between each transfer roller 19 and its corresponding photosensitive drum 31.

A cleaning roller 21 is disposed below the belt unit 15 to remove impurities such as toner and paper dust adhering to the conveyor belt 18. The cleaning roller 21 is formed by covering a metallic shaft member with a foaming material of silicone. The cleaning roller 21 faces a metallic backup roller 22 provided in the belt unit 15 via the conveyor belt 18. A specified bias is applied between the cleaning roller 21 and the backup roller 22, so that impurities such as toner on the conveyor belt 18 are electrically attracted to the cleaning roller 21. The cleaning roller 21 makes contact with a metallic collecting roller 23 for removing impurities such as toner and dust adhered to the cleaning roller 21, and the collecting roller 23 makes contact with a blade 24 which scrapes impurities such as toner adhering to the collecting roller 23.

A scanner unit 27 is provided inside an upper part of the body casing 2. The process unit 25 is disposed below the scanner unit 27, and the belt unit 15 is disposed below the process unit 25.

In the scanner unit 27, laser light L emitted for each color based on specified image data is irradiated at high speed on the corresponding one of the photosensitive drums 31.

The process unit 25 includes four image formation units 26 for magenta, yellow, cyan and black, disposed in tandem. Each image formation unit 26 includes the photosensitive drum 31 as an image carrier, a scorotron charger 32, and a developer cartridge 34 as a developing device. The process unit 25 further includes a frame 29 having four cartridge installation portions 30 provided in alignment. Each cartridge installation portion 30 is open at the top and bottom, so as to hold the corresponding developer cartridge 34 in a detachable manner.

In the frame 29, the photosensitive drum 31 of each image formation unit 26 is held at a lower end of the cartridge installation portion 30, and the scorotron charger 32 is held adjacent to the photosensitive drum 31.

The photosensitive drum 31 is constructed from a grounded metallic drum body, which is coated with a positively chargeable photosensitive layer made from polycarbonate.

The scorotron charger 32 is disposed diagonally to the rear and above the photosensitive drum 31. The scorotron charger 32 is a specified distance away from and not in contact with the photosensitive drum 31. The scorotron charger 32 generates a corona discharge from a charging wire (not shown), such as a tungsten wire, so as to positively and uniformly charge the surface of the photosensitive drum 31.

The developer cartridge 34 is substantially box-shaped, and is provided with a toner chamber 38 at an upper portion thereof. A supply roller 39, a developing roller 40, and a layer-thickness regulating blade 41 are provided at a lower portion of the developer cartridge 34. Each toner chamber 38 contains non-magnetic single-component toner of a different color of yellow, magenta cyan, and black. Each toner chamber 38 is provided with an agitator 42 for agitating toner.

The supply roller 39 is formed by covering a metallic roller shaft with a conductive foam material. The developing roller 40 is formed by covering a metallic roller shaft with a conductive rubber material. Toner discharged from the toner chamber 38 is supplied to the developing roller 40 through the rotation of the supply roller 39, and is positively charged by friction between the supply roller 39 and the developing roller 40. The rotation of the developing roller 40 causes the toner to enter the region between the layer thickness regulating blade 41 and the developing roller 40 and the toner becomes further fully charged by friction, is uniformly regulated to a specified thickness, and is carried on the developing roller 40.

The surface of the photosensitive drum 31 is uniformly and positively charged by the scorotron charger 32 during its rotation, and is exposed to the laser light emitted from the scanner unit 27 by high speed scanning. Thus, an electrical latent image corresponding to an image to be formed on a sheet 4 is formed on the surface of the photosensitive drum 31.

When the positively charged toner carried on the developing roller 40 contacts the photosensitive drum 31 through the rotation of the developing roller 40, the toner is supplied to the electrical latent image formed on the surface of the photosensitive drum 31. Thus, the electrical latent image on the photosensitive drum 31 is visualized with the toner adhered to only a light exposed portion, and a toner image is carried on the surface of the photosensitive drum 31.

Then, while a sheet 4 passes a transfer position between the photosensitive drum 31 and the transfer roller 19 in each image formation unit 26, the toner images carried on the surface of each photosensitive drum 31 are sequentially transferred onto the sheet 4 being conveyed by the conveyor belt 18 with a negative transfer bias to be applied to the transfer roller 19. The sheet 4 where the toner images have been transferred is then fed to a fixing device 43.

The fixing device 43 is disposed at the rear of the conveyor belt 18 in the body casing 2. The fixing device 43 includes a heat roller 44 and a pressure roller 45. The heat roller 44 having a heat source such as a halogen lamp is rotatably driven. The pressure roller 45 disposed under the heat roller 44 presses against the heat roller 44, and is rotated by the heat roller 44. In the fixing device 43, the sheet 4 carrying four color toner images is pinched, fed, and heated between the heat roller 44 and the pressure roller 45, so that the images are fixed to the sheet 4. The sheet 4 on which the images have been fixed is fed to ejection rollers 47 provided in an upper portion of the body casing 2 by a feed roller 46 disposed diagonally to the rear above the fixing device 43, and is ejected by the ejection rollers 47 and stacked on the output tray 5.

Exhaust Structure Inside the Body Casing

Figure 3:
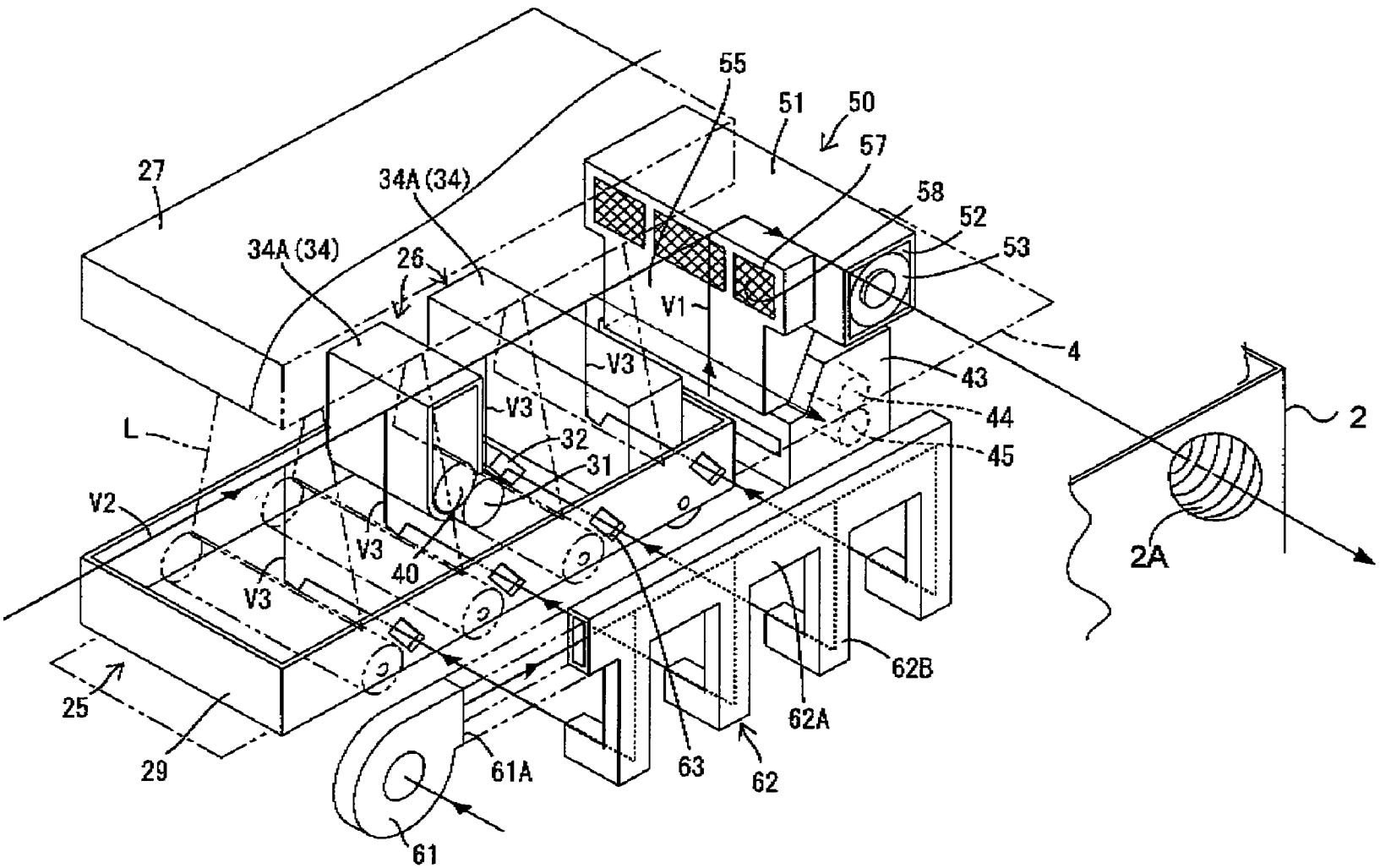
FIG. 3 is a perspective view schematically showing an illustrative exhaust structure of the laser printer according to an illustrative aspect.

FIG. 3 is a perspective view schematically showing an exhaust structure of the laser printer. An exhaust duct 50 is provided behind the process unit 25 in the body casing 2. The exhaust duct 50 is box-shaped. The exhaust duct 50 is thinner in the front-rear direction, and has a width greater than the width of the process unit 25. The exhaust duct 50 includes a substantially quadratic prism shaped duct body 51 in an upper portion of the exhaust duct 50. The exhaust duct 50 has a vent 52 on a right end, viewed from the front of the duct body 51. An exhaust fan 53 is disposed inside the vent 52. On a side of the body casing 2, there is an exhaust outlet 2A at a height corresponding to the vent 52. Air in the duct body 51 is discharged from the body casing 2 through the vent 52 and the exhaust outlet 2A in response to the rotation of the exhaust fan 53.

The exhaust duct 50 includes an extension 55 extending downward from the duct body 51. At the bottom of the extension 55, a fixing device-side suction hole 56 opens as shown in FIG. 1. The fixing device-side suction hole 56 is sandwiched between the fixing device 43 and the process unit 25 and disposed slightly above the bottom of the process unit 25 (or the upper surface of the conveyor belt 18). With this configuration, inside the body casing 2, a fixing device-side ventilation passage V1 is formed in which air in the vicinity of the fixing device 43 and air in the vicinity of the lower portion of the process unit 25 are channeled from the fixing device-side suction hole 56, via the extension 55, the duct body 51, and the vent 52, to the exhaust outlet 2A of the body casing 2.

Each developer cartridge 34 in the process unit 25 is maintained so that it partially protrudes upward from the frame 29. A top surface 34A is substantially a horizontal surface. In the scanner unit 27 disposed above the process unit 25, a bottom surface 27A is substantially a horizontal surface. The bottom surface 27A is disposed parallel to and a specified distance away from the top surface 34A of each developer cartridge 34. A space between the top surface 34A of each developer cartridge 34 and the bottom surface 27A of the scanner unit 27 is defined as an air escape space S required for pulling out the process unit 25. An air inlet 60 is provided at the front part of the air escape space S between the top end of the front cover 3 and the body casing 2. On the front of the duct body 51, scanner-side suction holes 57 are provided at substantially the same level as the top surface 34A of each developer cartridge 34. The scanner-side suction holes 57 are provided with filters 58 for removing impurities. With this configuration, inside the body casing 2, a scanner-side ventilation passage V2 is formed in which air coming in from the air inlet 60 is channeled to the exhaust outlet 2A of the body casing 2 via the air escape space S, the scanner-side suction hole 57, the duct body 51, and vent 52. The scanner-side ventilation passage V2 is configured to be substantially horizontal in a downstream air flow direction.

Figure 2:
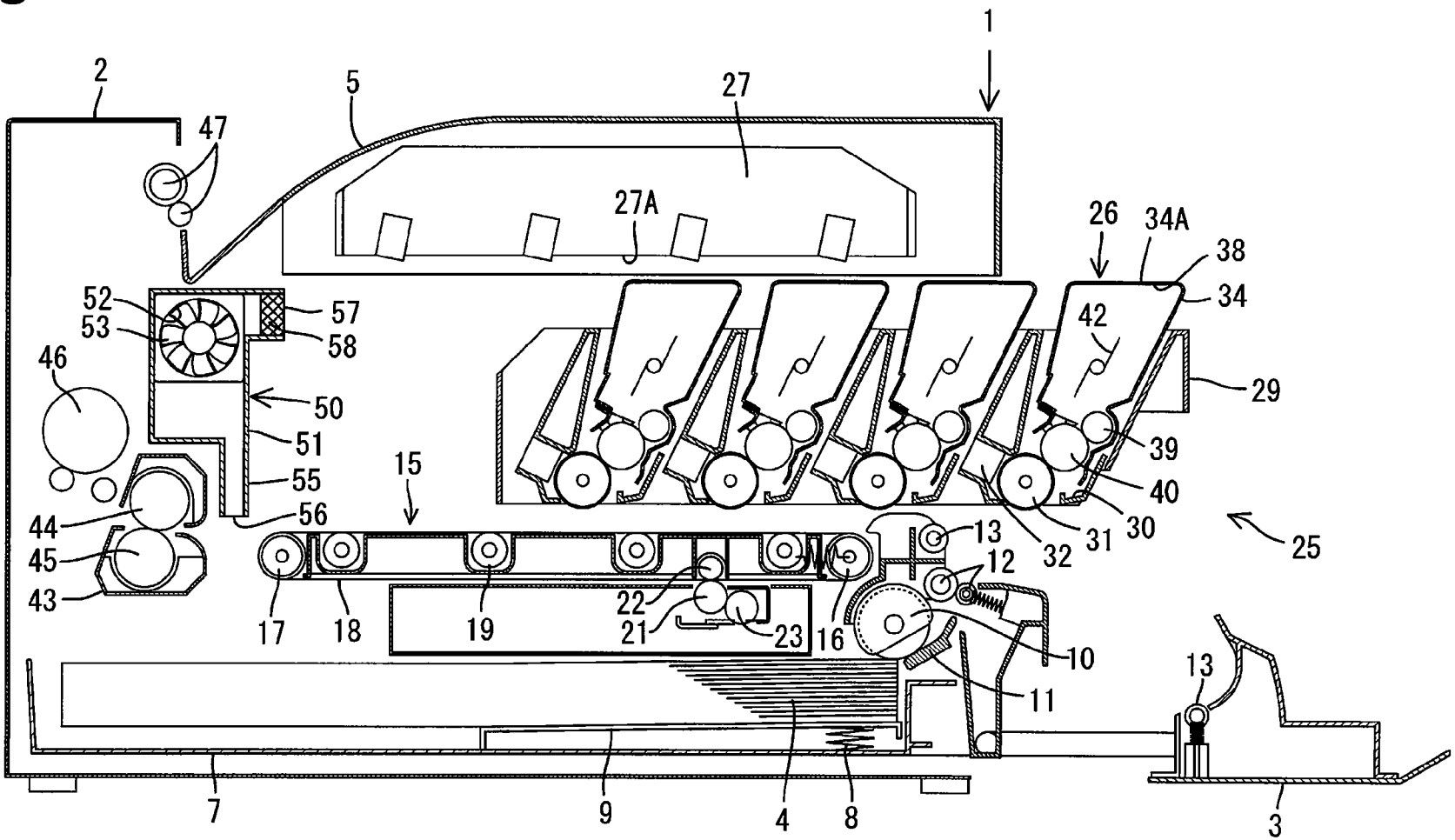
FIG. 2 is a side sectional view of the laser printer from which a process unit is being removed.

When the process unit 25 is pulled out from the body casing 2, as shown in FIG. 2, the front cover 3 is opened and the frame 29 of the process unit 25 is pulled toward the front. With this pulling operation, the process unit 25 is moved diagonally upward by a guide means, not shown, provided in the body casing 2. At this time, the upper part of the process unit 25 enters the air escape space S provided between the upper part of the process unit 25 and the scanner unit 27. Each photosensitive drum 31 of the process unit 25 is separated from the conveyor belt 18, so that each photosensitive drum does not slide along the surface of the conveyor belt 18. As such, the process unit 25 can be smoothly pulled out.

Inside the body casing 2, as shown in FIG. 3, a fan 61 for blowing air into each scorotron charger 32 is provided on the front right side viewed from the front of the process unit 25. The fan 61 is a so-called sirocco fan, and is configured to blow air taken in from the side in a rearward direction through an outlet 61A. The outlet 61A is connected to an air duct 62. In FIG. 3, the outlet 61A and the air duct 62 are separated for the sake of convenience, though such a configuration is not required. The air duct 62 includes a main body 62A extending from the outlet 61A rearward, and four branches 62B extending from the main body 62A. Each of the branches 62B extends downward from the main body 62A and then bends to the left when viewed from the front. An end portion of each branch 62B is disposed at a level corresponding to one of the communication holes 63 provided on a side of the frame 29 in the process unit 25. In FIG. 3, the end of each branch 62B is separated from the corresponding communication hole 63 of the frame 29. Each communication hole 63 of the frame 29 is open toward an end portion of the corresponding scorotron charger 32. The branches 62B of the air duct 62 communicate with an internal space of the scorotron chargers 32 via the corresponding communication holes 63. Thus, air from the fan 61 is blown in the scorotron chargers 32 via the air duct 62 and the communication holes 63.

In the body casing 2, charger-side ventilation passages V3 are formed in which air blowing out from each scorotron charger 32 to the photosensitive drums 31 side is channeled upward from the upper portion of the photosensitive drums 31 between a rear surface of each developer cartridge 34 and an inner wall of each cartridge installation portion 30 to the upper portion of the process unit 25. The air channeled to the upper portion of the process unit 25 through the charger-side ventilation passages V3 mixes with the air flowing in the scanner-side ventilation passage V2. Impurities such as toner contained in the air can be removed by the filters 58 at the scanner-side suction holes 57. Then, the air is discharged through the exhaust outlet 2A of the body casing 2 via the duct body 51 and the vent 52. The charger-side ventilation passages V3 also serve as passages for passing laser light L emitted from the scanner unit 27 to each of the photosensitive drums 31.

According to the above aspects, aside from the fixing device-side ventilation passage V1 for channeling air in the vicinity of the fixing device 43 to the exhaust outlet 2A, the scanner-side ventilation passage V2 for channeling air between the process unit 25 and the scanner unit 27 to the exhaust outlet 2A is provided. Thus, heat in the vicinity of the process unit 25 can be prevented from being conveyed toward the scanner unit 27.

Air is brought into the scorotron chargers 32 by the fan 61. The air blowing out from the scorotron chargers 32 is channeled to the charger-side ventilation passages V3, and mixes with the scanner-side ventilation passage V2, and is discharged. Thus, impurities such as toner and dust can be prevented from entering the scorotron chargers 32 and adhering to the charging wires.

Air blowing out from the single fan 61 is channeled to each of the scorotron chargers 32 by the air duct 62 having the branches 62B. Thus, the configuration is simple compared with a case where a fan is provided for each scorotron charger 32.

The air escape space S for separating the process unit 25 from the conveyor belt 18 also serves as the scanner-side ventilation passage V2. Thus, space inside the body casing 2 can be effectively used, and the apparatus can be developed into a smaller version.

The scanner-side ventilation passage V2 becomes horizontal in the downstream air flow direction, and warmer air is channeled in a natural direction. Thus, discharge of air can be effectively carried out.

While the invention has been described with reference to exemplary aspects, it is to be understood that the invention is not restricted to the particular forms shown in the foregoing exemplary aspects. Various modifications and alterations can be made thereto without departing from the scope of the invention.

The above aspects describe a laser printer of direct transfer type where a toner image of each color is transferred on a recoding medium (a sheet) directly from an image holding member (each photosensitive drum). However, the invention is not limited to this kind of printer. Aspects of the invention may be applied to a tandem color laser printer of intermediate transfer type where a toner image of each color is once transferred from each photosensitive member to an image receiver member such as an intermediate transfer belt or drum, and then transferred to a recording medium.

The above aspects involve a printer using four colors of toner, yellow, magenta, cyan and black. However, the invention is not limited to these colors. For example, aspects of the invention may be applied to a printer using two colors of toner such as red and black, or six colors of toner.

The above aspects show that the scanner-side ventilation passage is configured substantially horizontally. However, the scanner-side ventilation passage may be configured to have an upward gradient toward a downstream air flow direction.

The above aspects show that the process unit is horizontally inserted into or pulled out from the body casing. However, aspects of the invention may be applied to a process unit, which cannot be pulled out or can be pulled out diagonally upward.

What is claimed is:

1. An image forming apparatus comprising:

a body casing having an outlet;

a process unit including a plurality of image formation units arranged in a first direction, each of the image formation units having an image carrier, a charger, and a developing device, the process unit having a surface extending in the first direction;

a scanner unit disposed facing and spaced apart from the process unit and configured to expose the image carrier in each of the image formation units, the scanner unit having a surface extending in the first direction and facing the surface of the process unit;

a fixing device disposed in the first direction with respect to the process unit;

a first passage defined by the surface of the process unit and the surface of the scanner unit, the first passage being configured to channel air between the surface of the process unit and the surface of the scanner unit to the outlet in the first direction; and a second passage configured to channel air in the vicinity of the fixing device to the outlet in a second direction that crosses the first direction.

2. The image forming apparatus according to claim 1, further comprising:

a first fan configured to discharge air through the outlet;

a second fan configured to blow air toward the charger in each of the image formation units; and a third passage configured to channel air from the charger in each of the image formation units to the first passage.

3. The image forming apparatus according to claim 2, further comprising a duct having an inlet and a plurality of outlets configured to channel air from the second fan to the charger in each of the image formation units.

4. The image forming apparatus according to claim 1, further comprising a conveyor belt disposed to face a side of the process unit opposite the surface of the process unit facing the scanner unit, the conveyor belt being and configured to feed a recording medium to each of the image formation units, wherein the process unit is configured to be separated from the conveyor belt, and the process unit is configured to be moved into the first passage when the process unit is separated from the conveyor belt.

5. The image forming apparatus according to claim 2, further comprising:

a cover disposed at a side surface of the body casing, the cover configured to open and close; and an air inlet disposed at an end of the cover, wherein the process unit is configured to be removed from the body casing when the cover is open, the process unit is disposed between the air inlet and the first fan, and the first passage connects the air inlet and the first fan.

6. The image forming apparatus according to claim 5, wherein the first passage is configured to extend in the first direction from the air inlet toward the first fan, and the fixing device is disposed under the first fan.

7. The image forming apparatus according to claim 5, wherein the first passage is configured to have an upward gradient from the air inlet toward the first fan, and the fixing device is disposed under the first fan.

8. The image forming apparatus according to claim 4, wherein the process unit is configured to be separated from the conveyor belt in an upward direction.

9. An image forming apparatus comprising:

a body casing having an outlet;

a process unit including a plurality of image formation units arranged in a first direction, each of the image formation units having an image carrier, a charger, and a developing device, the process unit having a top surface extending in the first direction;

a scanner unit disposed above the process unit and configured to expose the image carrier in each of the image formation units to light, the scanner unit having a bottom surface extending in the first direction, the bottom surface facing the top surface of the process unit;

a first passage defined by the top surface of the process unit and the bottom surface of the scanner unit, the first passage being configured to channel air between the top surface of the process unit and the bottom surface of the scanner unit to the outlet in the first direction;

a first fan configured to discharge air through the outlet;

a second fan configured to blow air toward the charger in each of the image formation units; and a second passage configured to channel air from the charger in each of the image formation units to the first passage.

10. The image forming apparatus according to claim 9, further comprising a duct having an inlet and a plurality of outlets configured to channel air from the second fan to the charger in each of the image formation units.

11. The image forming apparatus according to claim 9, further comprising a conveyor belt disposed below the process unit and configured to feed a recording medium to each of the image formation units, wherein the process unit is configured to be separated from the conveyor belt, and removed from the body casing, and the process unit is configured to be moved into the first passage when the process unit is separated from the conveyor belt.

12. The image forming apparatus according to claim 11, wherein the process unit is configured to be separated from the conveyor belt in an upward direction.

13. An image forming apparatus comprising:

a body casing having an outlet;

a conveyor configured to feed a recording medium;

a process unit including a plurality of image formation units arranged in a first direction that is a substantially horizontal direction, each of the image formation units having an image carrier, a charger, and a developing device, the process unit disposed above the conveyor, the process unit configured to be separated from the conveyor and to be removed from the body casing;

a scanner unit disposed above the process unit and configured to expose the image carrier in each of the image formation units;

a first fan configured to discharge air through the outlet; and a passage configured to channel air between the process unit and the scanner unit to the outlet in the first direction, wherein the process unit is configured to be moved into the passage when the process unit is separated from the conveyor.

14. The image forming apparatus according to claim 13, wherein the process unit is configured to be separated from the conveyor in an upward direction.

15. An image forming apparatus comprising:

a body casing having an outlet and an air inlet provided on opposite sides of the body casing;

a conveyor configured to feed a recording medium;

a process unit including a plurality of image formation units arranged in a substantially horizontal direction, each of the image formation units having an image carrier, a charger, and a developing device, the process unit disposed above the conveyor, the process unit configured to be separated from the conveyor and to be removed from the body casing;

a scanner unit disposed above the process unit and configured to expose the image carrier in each of the image formation units;

a first fan disposed proximate to the outlet;

a fixing section disposed under the first fan; and an air passage connecting the outlet and the air inlet, wherein the process unit is configured to be moved into the air passage when the process unit is separated from the conveyor.

16. The image forming apparatus according to claim 15, further comprising a duct including the first fan, an upper opening, and a lower opening, wherein the upper opening communicates with the air passage, and the lower opening communicates with the fixing section.

17. The image forming apparatus according to claim 15, further comprising a second fan configured to blow air toward the charger in each of the image formation units; and a duct having an inlet and a plurality of outlets configured to channel air from the second fan to the charger in each of the image formation units.

18. The image forming apparatus according to claim 15, wherein the process unit is configured to be separated from the conveyor in an upward direction.

19. The image forming apparatus according to claim 1, wherein the surface of the process unit is a top surface and the surface of the scanner unit is a bottom surface.

20. The image forming apparatus according to claim 19, further comprising a conveyor belt disposed below the process unit and configured to feed a recording medium to each of the image formation units, wherein the process unit is configured to be separated from the conveyor belt, and moved into the first passage when the process unit is separated from the conveyor belt.

21. An image forming apparatus comprising:

a body casing;

a process unit including a frame and a plurality of image formation units arranged in the frame in a first direction that is a substantially horizontal direction, each of the image formation units having an image carrier, a charger, and a developing device, the developing device being configured to be removed from the frame and the process unit being configured to be removed from the body casing;

a belt unit disposed below the process unit, the belt unit including a belt that is disposed facing the image carrier of each of the image formation units; and a scanner unit disposed above the process unit and configured to expose the image carrier of each of the image formation units; and a passage provided between the process unit and the scanner unit, wherein the process unit is configured to be separated from the belt unit, and to be moved into the passage when the process unit is separated from the belt unit.

22. The image forming apparatus according to claim 21, wherein the belt unit is configured to feed a recording medium.

23. The image forming apparatus according to claim 22, wherein the image carrier of each of the image formation units is configured to transfer an image onto a recording medium fed by the belt unit.

24. The image forming apparatus according to claim 21, wherein the process unit includes a top surface extending in the first direction, the scanner unit includes a bottom surface extending in the first direction and facing the top surface of the process unit, the passage is defined by the top surface of the process unit and the bottom surface of the scanner unit, and the passage is configured to channel air between the top surface of the process unit and the bottom surface of the scanner unit in the first direction.

25. The image forming apparatus according to claim 21, further comprising:

a fan configured to move air in the passage; and a fixing device disposed at one end in the first direction, the fixing device and the fan being disposed at the one end.

26. The image forming apparatus according to claim 25, wherein the process unit includes a top surface extending in the first direction, the scanner unit includes a bottom surface extending in the first direction and facing the top surface of the process unit, the passage is defined by the top surface of the process unit and the bottom surface of the scanner unit, and the passage is configured to channel air between the top surface of the process unit and the bottom surface of the scanner unit in the first direction.

* * * * *